United States Patent [19]

Schmidt et al.

[11] Patent Number: 5,067,715

[45] Date of Patent: Nov. 26, 1991

[54] HOLLOW, METALLIC GOLF CLUB HEAD WITH DENDRITIC STRUCTURE

[75] Inventors: Glenn H. Schmidt, Malibu; John P. Sheehan, Covina; Richard C. Helmstetter, Carlsbad, all of Calif.

[73] Assignee: Callaway Golf Company, Carlsbad, Calif.

[21] Appl. No.: 595,963

[22] Filed: Oct. 16, 1990

[51] Int. Cl.[5] ..... A63B 53/08

[52] U.S. Cl. ..... 273/167 F; 273/167 H

[58] Field of Search ..... 273/167 R, 167 F–167 H, 273/173, 169, 78

[56] References Cited

U.S. PATENT DOCUMENTS

| | | | |
|---|---|---|---|
| 1,658,581 | 2/1928 | Tobia | 273/169 |
| 2,087,685 | 7/1937 | Hackney | 273/169 |
| 4,214,754 | 7/1980 | Zebelean | 273/167 F |
| 4,432,549 | 2/1984 | Zebelean | 273/167 H |
| 4,511,145 | 4/1985 | Schmidt | 273/167 H |
| 4,872,685 | 10/1989 | Sun | 273/173 |
| 4,930,781 | 6/1990 | Allen | 273/167 H |

FOREIGN PATENT DOCUMENTS

| | | | |
|---|---|---|---|
| 1476889 | 6/1977 | United Kingdom | 273/167 H |
| 2100993 | 1/1983 | United Kingdom | 273/167 H |
| 2230459 | 10/1990 | United Kingdom | 273/167 H |

*Primary Examiner*—Edward M. Coven
*Assistant Examiner*—Steven B. Wong
*Attorney, Agent, or Firm*—William W. Haefliger

[57] ABSTRACT

A metal wood golf club head has an elongated, forwardly facing front wall to strike a golf ball, and a hollow body rearwardly of the face plate, the front wall elongated in a first transverse direction toward connection to a club shaft, the body having a thin, metallic top wall merging with upper transverse extent of the front wall. The head also includes a first group of narrow, metallic, shock wave distributing dendrites extending from the front wall generally rearwardly adjacent the underside of the top wall and integral therewith; the dendrites spaced apart in a transverse direction, the maximum height dimensions of the dendrites below the underside of the top wall being between 0.050 and 0.100 inches and the dendrites being downwardly convex in cross-section. A second group of such shock wave distributing dendrites is also typically provided rearwardly of the first dendrite group, and which extend rearwardly to merge with the head rear wall.

23 Claims, 2 Drawing Sheets

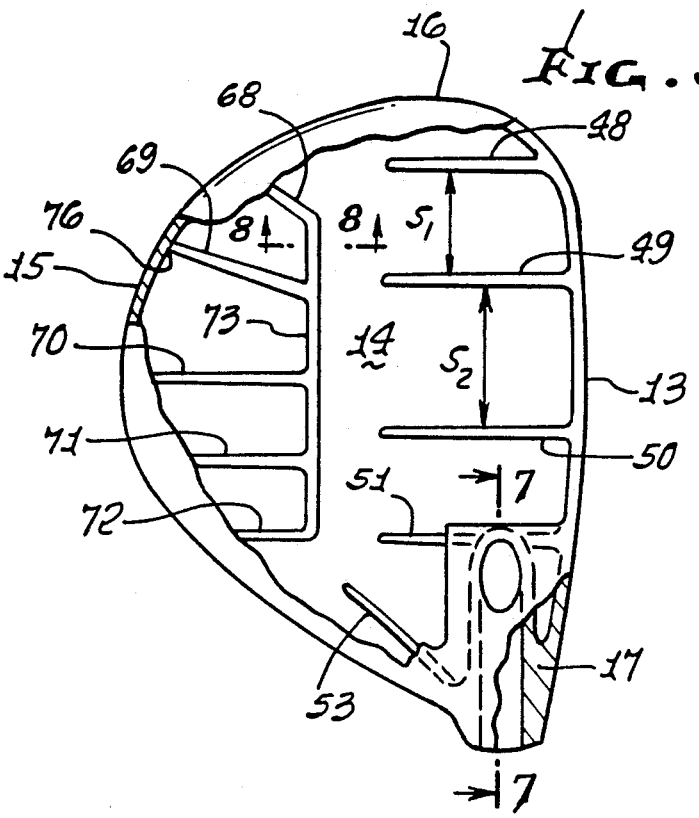
FIG. 5.
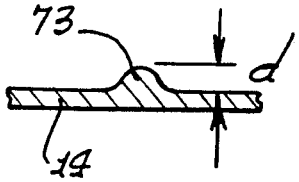
FIG. 8.
FIG. 6.
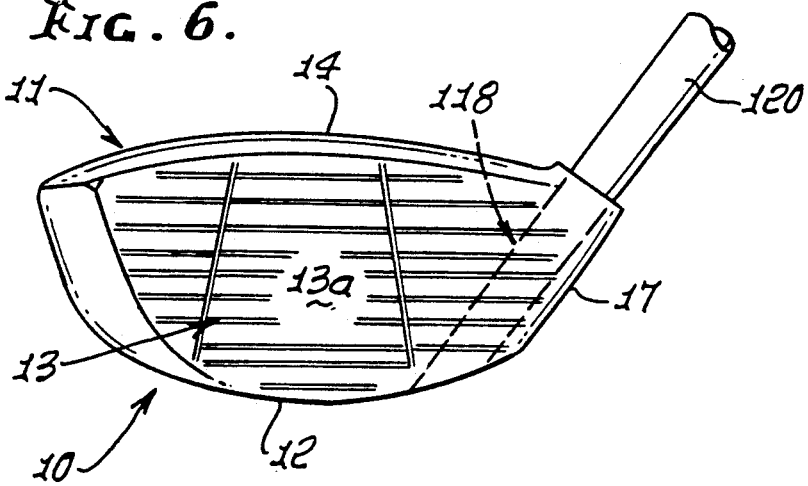
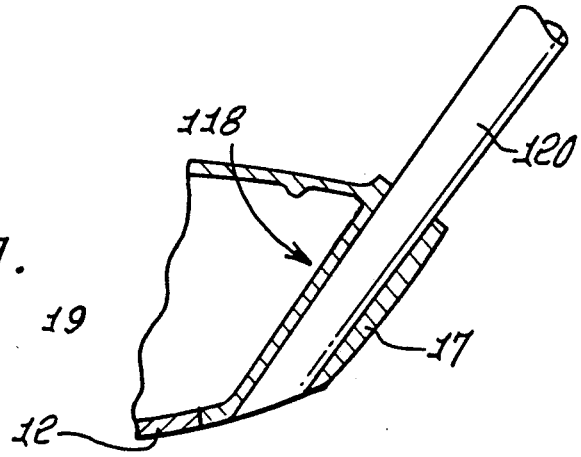
FIG. 7.

HOLLOW, METALLIC GOLF CLUB HEAD WITH DENDRITIC STRUCTURE

BACKGROUND OF THE INVENTION

This invention relates generally to increasing the size of metallic, hollow golf club heads (woods), without increasing head weight. More particularly, it concerns the distribution of ball impact waves from the head front wall in such manner as to resist deflection of that front wall and to absorb such shock waves on top and rear walls spaced apart from a metallic sole plate welded to the head.

Large, very thin-walled metal golf club heads present the problems of cracking and buckling of metal walls, and excessive front wall deflection, during ball impact. There is need to alter the manner in which shock waves are distributed within metal wood walls as by providing a mechanism which guides, interrupts, spreads, or otherwise alters the shock waves which emanate from the face at impact, but while maintaining optimum wall thicknesses.

SUMMARY OF THE INVENTION

It is a major object of the invention to provide structure overcoming the above problems and disadvantages. Basically, the improved head of the invention is characterized by a ball striking front wall, a bottom wall, and spaced toe and heel walls, as well as:

a) a first group of narrow, metallic, load distributing dendrites extending from the front wall generally rearwardly adjacent the underside of the top wall and integral therewith, b) the dendrites spaced apart in a transverse direction by amounts greater than their widths, the maximum height dimensions of the dendrites below the underside of the top wall being between 0.050 and 0.100 inches, generally, and the dendrites being downwardly generally convex in cross-section.

The dendrites are such as to transfer, spread, dampen and distribute impact produced shock so as to reduce shock wave concentration otherwise imposed on the junction between the front wall and top wall. Shock waves are produced by high speed impact of the club head with the golf ball which leaves the head only a few milliseconds after impact.

It is another object to provide hosel structure that extends downwardly into the head interior and forming a shaft receiving opening. This strengthens the connection of the front wall to the top and heel walls, and reduces hosel weight so that such weight can be utilized to form the dendrites, as referred to. In this regard, the invention enables the provision of a larger overall volume head as compared with a head of the same weight, but lacking the dendritic structure as referred to. As will be seen the use of such structure enables thinning of the hollow head top, toe, back, and heel walls.

Another object is to provide at least one additional dendrite extending from the hosel structure generally rearwardly and transversely, adjacent the underside of the top wall and integral therewith.

Yet another object is to provide c) a second set of narrow, metallic, load distributing dendrites extending generally rearwardly adjacent the underside of the top wall and integral therewith, the second set of dendrites also including a transversely extending central dendrite intersecting the generally rearwardly extending dendrites of the second set.

d) the dendrites of the second set located further from the front wall than the first set of dendrites, e) the rearwardly extending dendrites of the second set spaced apart in the transverse direction, the vertical dimensions of the second set dendrites also being less than about 0.060 inches, generally.

The central dendrite preferably may be larger in cross-section than those emanating from it. Also, the dendrites of the invention may typically have smooth contours, with generally convex tops and concave sides, along their lengths which conform to the hosel top wall shape, which may be arched. If five of the forward dendrites are provided, then, accordingly, four of the rearward dendrites may fan toward the rear wall; and if four of the forward dendrites are provided, then five rearward dendrites may be employed, as will be seen. Thus, the number of forward and rearward dendrites may be about the same, and distributed between the toe and heel. Various numbers of dendrites may be employed.

These and other objects and advantages of the invention, as well as the details of an illustrative embodiment, will be more fully understood from the following specification and drawings, in which:

DRAWING DESCRIPTION

Figure 1:
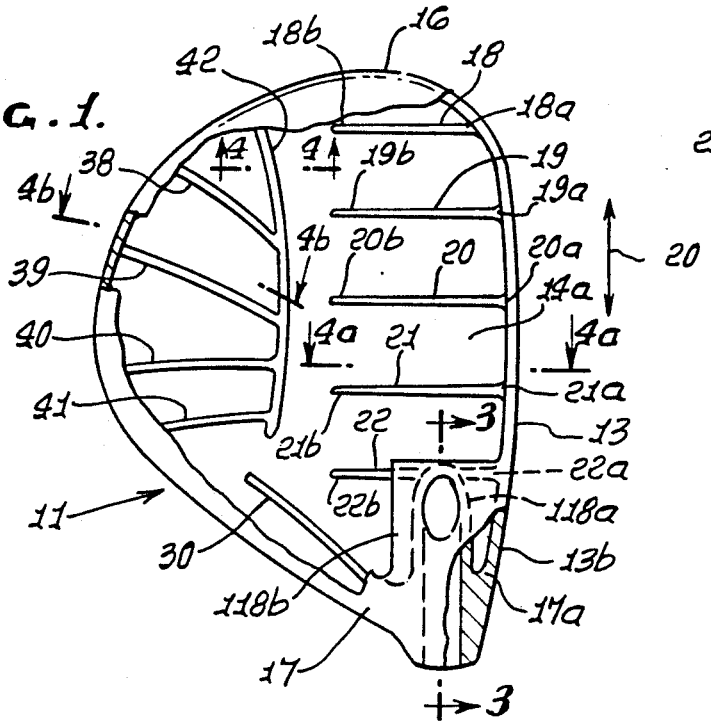
FIG. 1 is a plan view looking upwardly into a hollow metal wood head.
Figure 4A:
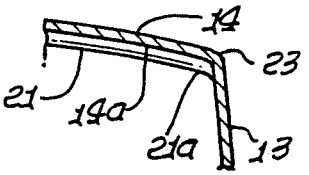
FIG. 4 is an enlarged fragmentary section taken on lines 4—4 of FIG. 1.
Figure 4:
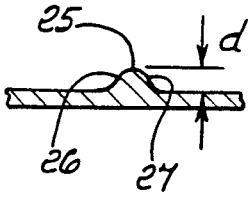
Figure 2:
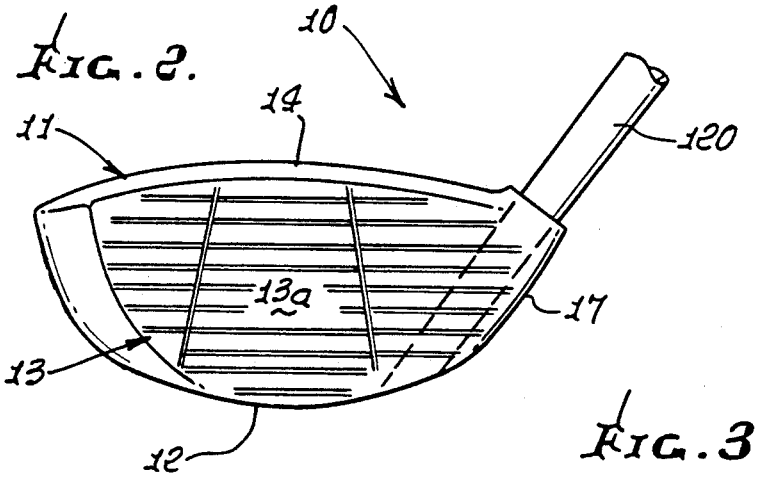
FIG. 2 is an elevation looking toward the front face of the FIG. 1 head.
Figure 3:
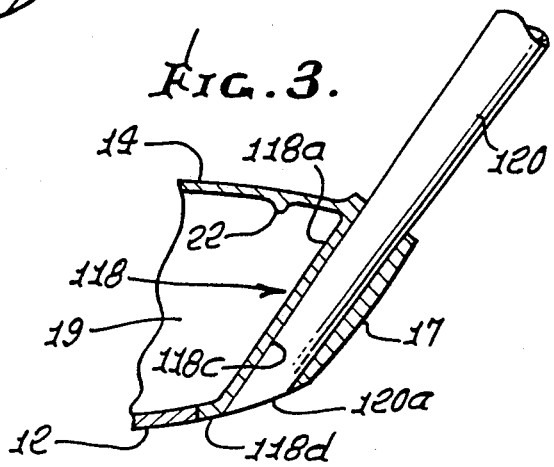
FIG. 3 is a fragmentary section taken on lines 3—3 of FIG. 1.
Figure 4B:
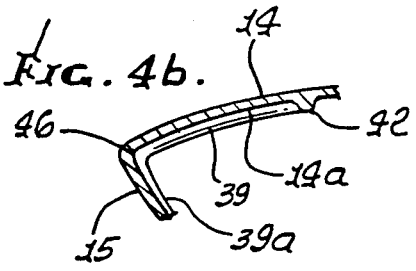

FIGS. 4*a* and 4*b* are fragmentary sections taken on lines 4*a*–*a* and 4*b*–4*b* of FIG. 1, respectively;

FIG. 5 is a view like FIG. 1 showing a modified head construction;

FIG. 6 is an elevation looking toward the front face of the FIG. 5 head;

FIG. 7 is a fragmentary section taken on lines 7—7 of FIG. 5; and

FIG. 8 is an enlarged section taken on lines 8—8 of FIG. 5.

DETAILED DESCRIPTION

In the drawings, the golf club 10 comprises a head in the form of a thin metallic body 11 typically cast, and having a metallic sole plate 12. These elements may consist of steel, stainless steel, or other material, and formed by processes other than investment casting. The hollow body includes a front wall or face plate 13 having a front surface 13*a* adapted to strike a golf ball, as well as top wall 14, rear wall 15, and toe and heel walls 16 and 17. A hosel 118 extends downwardly into the hollow interior 19 of the heel portion of the head, and is adapted to receive a shaft 120. Thus, the weight of the hosel is concentrated more directly behind, or close to, the rear side 13*b* of front wall 13, near the heel, to contribute to the ball striking mass of the front wall. Also, the hosel cylindrical wall 118*a* reinforces the junction of the front wall, bottom wall and heel wall 17, at locus 17*a*. See also hosel webbing or filleting at 118*b*, and hosel bore 118*c* receiving shaft 120. Shaft lower end 120*a* is shown flush with the bottom surface 118*d* of the hosel.

In accordance with an important aspect of the invention, a first group or set of narrow, metallic, dendrites is provided to extend from the front wall 13 generally rearwardly adjacent the underside 14*a* of the top or upper wall 14, and integral therewith. See, in the example, dendrites 18–22 spaced apart in a transverse direction indicated by arrows 20, the dendrites having forward ends 18*a*–22*a* merging into the front wall at its junctions with the top wall. Note the possible widening of the dendrites as they merge with front wall 13. This serves the purpose of distributing impact produced shock waves from the front wall to the top wall, together with junction 23, especially when a ball is hit high on the front wall or face. This in turn serves to prevent cracking and buckling of the thin metal wall 14. Note that the dendrites are spaced apart, i.e. branch at intervals of about ½ to ¾ inch; and that the rearward ends of the dendrites at 18*b*–22*b* are transversely spaced apart. The vertical dimension "d" of the dendrites lies within the range 0.050 to 0.070 inch, and the dendrites are generally convex at 25 toward the interior of the head, along their lengths, and have concave opposite sides at 26 and 27, (see FIG. 4). In this regard, the thickness of the front wall is typically substantially greater than the thickness of the other walls, to strengthen it and prevent cracking under high impact loads. Typical wall approximate thicknesses are: front wall 0.120 inches, sole plate 0.050 inches, and top wall 0.030 inches. These dimensions are less than standard thicknesses, allowing for a larger head and a larger moment of inertia for a given total weight. This in turn allows a greater "forgiveness effect" as regards off-center ball strikes.

Also shown is at least one additional dendrite, as at 30, extending from the hosel wall or structure generally rearwardly and transversely, adjacent the upwardly arching underside 14*a* of the top wall, and integral therewith. It is sized, in cross section, the same as dendrites 18–22, all of such dendrites having about the same cross sectional dimensions. Dendrite 30 distributes impact force or shock waves from the hosel rearwardly and transversely, along its length, and to the upper wall 14. Thus, shock waves are well distributed in their transfer to upper wall 14, as by the dendrites, to minimize risk of head cracking and buckling, especially along the angled junction 23.

Further, the conformation of the dendrites (see FIG. 4*a*) along their lengths, to head interior wall shape, contributes to shock wave distribution across the upper wall 14. Note that wall 14 may be upwardly crowned, i.e. upwardly shallowly convex.

Another aspect of the invention includes the provision of a second set or group of narrow, metallic, dendrites extending generally rearwardly adjacent the underside of the top wall and integral therewith, the second set also including a transversely extending dendrite intersecting the generally rearwardly extending dendrites of the second set. The dendritess of the second set are located further from the head front wall than said first set of dendrites, the rearwardly extending dendrites of the second set being spaced apart, or branching, in transverse direction, the vertical dimensions of the second set dendrites also being between 0.050 and 0.100 inches. See for example the four dendrites 38–41 that have fan configuration, radiating rearwardly from different points along the single dendrite 42 spaced rearwardly from dendrites 18–21. Dendrites 38–41 extend generally rearward to merge with the generally curved rear wall 15 of the head, to direct or transfer such rearward loading to that wall as the dendrites pick up loading from top wall 14. Dendrites 38–42 have generally the same configuration and dimensions as dendrites 18–22 and 30. Accordingly, they serve the same shock wave transfer distributing functions to minimize cracking and buckling of the thinned top wall at its junction at 46 with the rear wall. Note also that dendrites 38–42 conform to top wall shape along their lengths. See FIG. 4*b*. In addition, the rearward ends of the dendrite 38–41 turn downwardly adjacent the inner side of wall 15 and then downwardly and forwardly, as seen at 39*a* in FIG. 4*b*, for example.

In FIG. 5, the head itself is the same as in FIGS. 1–4, and the same identifying members are used. Forward dendrites 48–51 correspond to dendrites 18–22, but their transverse spacing "s" is greater, being about ½ inch to 1 inch. See spacings $s_1$ and $s_2$. Dendrites 48–51 have the same cross-sectional dimensions, and a generally convex-concave surface configuration, as do dendrites 18–22. Dendrite 53 corresponds to dendrite 30, in FIG. 1. All dendrites may for example have maximum height dimensions (below the top wall) of about 0.060 inches.

The five rearward dendrites 68–72 extend or fan rearwardly from a transverse dendrite 73, that corresponds to dendrite 42 in FIG. 1, and they intersect the rearward wall 15 of the head, at intersections along the junction line 76.

Dendrites 48–51 transfer loading from the front wall 13 to the top wall 14; and dendrites 68–72 transfer shock waves from the top wall to the rear wall 15. Dendrite 73 assists this function. Dendrite 53 transfers shook waves from the hosel to the top wall 14.

The number and position of dendrites may vary according to the various head sizes and shapes.

Finally the fact that the dendrites enable head wall thinning allows use of heavier density metallic compositions in the head walls, without reducing the head size below the sizes of standard hollow metal heads made of steel. For example, compositions such as berillium copper, tungsten, surgical steel alloys, and cobalt alloys can be used. In the past such heavier metal compositions could not be used without reducing head size.

We claim:

1. In a metal wood golf club head having an elongated, forwardly facing front wall to strike a golf ball, and a hollow body rearwardly of the face plate that includes a curved rear wall, the front wall elongated in a first transverse direction toward a connection to a club shaft, the body having a thin, metallic top wall merging with upper transverse extent of the front wall, the combination comprising:

a) a first group of narrow, metallic, shock wave distributing dendrites extending from said front wall generally rearwardly adjacent the underside of the body top wall and integral therewith, b) the dendrites spaced apart in said transverse direction, by amounts greater than their widths, the maximum height dimensions of the dendrites below the underside of the top wall being between 0.050 inches and 0.100 inches and the dendrites being generally downwardly convex in cross-section, c) there being a second group of dendrites integral with said top wall and which are spaced apart in said transverse direction, and which extend generally rearwardly to merge rearwardly and downwardly with said curved rear wall to transfer rearward loading to that wall as the dendrites pick up rearward loading from said top wall in response to front wall impact with a golf ball.

2. The combination of claim 1 wherein said connection is defined by hosel structure extending downwardly within the body hollow, and forming a shaft receiving opening.

3. The combination of claim 2 including at least one additional reinforcement dendrite extending from said hosel structure generally rearwardly and transversely, adjacent the underside of the top wall and integral therewith.

4. The combination of claim 3 wherein the dendrites, body and front wall all comprise part of a single metallic casting.

5. The combination of claim 1 wherein the front wall has thickness substantially greater than the thickness of the top wall, and said dendrites of the first group merge with the inner side of said front wall.

6. The combination of claim 1 including d) said second group of narrow, metallic, shock wave distributing dendrites extending generally rearwardly adjacent the underside of the top wall and integral therewith, the second set of dendrites also including a transversely extending dendrite intersecting said generally rearwardly extending dendrites of the second set, e) the dendrites of the second group located further form said front wall than said first group of dendrites, f) the rearwardly extending dendrites of the second group spaced apart in said transverse direction, the maximum height dimensions of the second group dendrites being between 0.050 and 0.100 inches.

7. The combination of claim 6 wherein the head has a sole plate, a rear wall and side wall extending between the top wall and sole plate, the first group of dendrites spaced from said side walls and rear wall.

8. The combination of claim 6 wherein the head has a sole plate, and side walls extending between the top wall and sole plate, certain rearwardly extending dendrites of the second group also extending downwardly and forwardly at said rear wall.

9. The combination of claim 6 wherein said dendrites of the second group are upwardly arched along their rearwardly extending lengths.

10. The combination of claim 6 wherein the dendrites of the second group have cross-sectional configuration that includes a convex dome and concave opposite sides.

11. The combination of claim 1 wherein said dendrites of the first group are upwardly arched along their rearwardly extending lengths.

12. The combination of claim 1 wherein said dendrites of the first group have cross-sectional configuration that includes a convex dome and concave opposite sides.

13. The combination of claim 1 wherein there are five of said first group dendrites that are substantially equally spaced apart across the width of the head between the toe and heel.

14. The combination of claim 1 wherein there are four of said first group dendrites that are substantially equally spaced apart across the width of the head between the toe and heel.

15. The combination of claim 1 wherein the top wall has thickness of about 0.030 inches, between said dendrites.

16. The combination of claim 1 wherein said connection is defined by a hosel which is one piece with the body and dendrites.

17. In a metal wood golf club head having an elongated, forwardly facing front wall to strike a golf ball, and a hollow body rearwardly of the face plate that includes a curved rear wall which is rearwardly convex, the front wall elongated in a first transverse direction toward a connection to a club shaft, the body having wall means including a thin, metallic top wall merging with upper transverse extend of the front wall, the combination comprising:

a) a first group of narrow, metallic, shock wave distributing dendrites extending from said front wall generally rearwardly adjacent the underside of the body top wall and integral therewith, b) the dendrites spaced apart in said transverse direction, by amounts greater than their widths, the maximum height dimensions of the dendrites below the underside of the top wall being between 0.050 inches and 0.100 inches, c) the body wall means being thinned and the head having larger overall volume as compared with a head of the same weight but lacking said dendrites, d) there being dendrites integral with said top wall and which are spaced apart in said transverse direction, and which extend generally rearwardly to merge rearwardly and downwardly with said curved rear wall to transfer rearward loading to that wall as the dendrites pick up rearward loading from said top wall in response to front wall impact with a golf ball.

18. In a metal wood golf club head having an elongated, forwardly facing front wall to strike a golf ball, and a hollow body rearwardly of the face plate that includes a curved rear wall that is rearwardly convex, the front wall elongated in a first transverse direction toward a zone of connection to a club shaft, the body having a thin, metallic top wall merging with upper transverse extent of the front wall, the combination comprising:

a) a first group of narrow, metallic, shock wave distributing dendrites extending from said front wall generally rearwardly adjacent the underside of the body top wall and integral therewith, b) the dendrites spaced apart in said transverse direction, by amounts greater than their widths, the maximum height dimensions of the dendrites below the underside of the top wall being between 0.050 inches and 0.100 inches, c) the head top wall thickness between the dendrites being about 0.030 inches, the head front wall having about 0.120 inches thickness, and the head having a sole plate with thickness of about 0.050 inches, the head being larger than and having a larger moment of inertia than a hollow metallic head lacking said dendrites, d) there being dendrites integral with said top wall and which are spaced apart in said transverse direction, and which extend generally rearwardly to merge rearwardly and downwardly with sad curved rear wall to transfer rearward loading to that wall as the dendrites pick up rearward loading from said top wall in response to front wall impact with a golf ball.

19. The combination of claim 18 wherein said dendrites, which merge with said curved rear wall, also extend downwardly and forwardly.

20. The combination of claim 19 wherein the body wall means consists essentially of berillium copper alloy.

21. The combination of claim 19 wherein the body wall means consists essentially of tungsten alloy.

22. The combination of claim 19 wherein the body wall means consists essentially of cobalt alloy.

23. The combination of claim 19 wherein the body wall means consists essentially of surgical steel alloy.

* * * * *